US006247903B1

(12) United States Patent
Wong

(10) Patent No.: US 6,247,903 B1
(45) Date of Patent: Jun. 19, 2001

(54) PRESSURE FLUCTUATION DAMPENING SYSTEM

(75) Inventor: Larry Ping-Kwan Wong, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/277,712

(22) Filed: Mar. 26, 1999

(51) Int. Cl.[7] ..... F04B 49/00
(52) U.S. Cl. ..... 417/279; 417/280
(58) Field of Search ..... 417/279, 435, 417/425; 222/135, 145, 255

(56) References Cited

U.S. PATENT DOCUMENTS

| | | | | |
|---|---|---|---|---|
| 2,819,835 | * | 1/1958 | Newhall | 417/279 |
| 3,910,462 | * | 10/1975 | Abeles et al. q | 222/135 |
| 4,897,022 | * | 1/1990 | Hudson | 417/7 |
| 5,038,563 | * | 8/1991 | McMahan et al. | 60/413 |
| 5,464,328 | | 11/1995 | Stoeger | 417/44.8 |
| 5,538,396 | * | 7/1996 | Meierhoefer | 417/19 |
| 5,685,851 | * | 11/1997 | Murphy et al. | 604/150 |

FOREIGN PATENT DOCUMENTS

| | | | |
|---|---|---|---|
| 08144960 | 6/1996 | (JP) | F04B/49/06 |
| 09283477 | 10/1997 | (JP) | H01L/21/304 |

* cited by examiner

*Primary Examiner*—Philip H. Leung
*Assistant Examiner*—Thor Campbell
(74) *Attorney, Agent, or Firm*—Martine & Penilla, LLP

(57) ABSTRACT

A pressure booster and method for amplifying a water pressure that is supplied by water facility is provided. The pressure booster is configured to be connected between he water facility and one or more semiconductor substrate cleaning systems. The pressure booster includes a pump having a pump input that connects to the water facility and a pump output that is configured to produce a fluctuating amplified water pressure that is greater than the water pressure that is supplied by the water facility. Further included is a pressure dampener having a dampener input for accepting the fluctuating amplified water pressure from the pump output. The pressure dampener is configured to partially reduce pressure fluctuations in the fluctuating amplified water pressure. The pressure dampener also has a dampener output. A pressure regulator having a regulator input for receiving the dampener output is also included as part of the pressure booster. The pressure regulator has a regulator output that is configured to supply an amplified water pressure having a substantially reduced pressure fluctuation, and an adjustment control that is connected to the pressure regulator. The adjustment control is provided to enable precision turning of the pressure fluctuations at the output of the pressure regulator, such that a substantially more stable water supply can be provided to the cleaning system(s) connected to the pressure booster.

6 Claims, 5 Drawing Sheets

PRESSURE FLUCTUATION DAMPENING SYSTEM

BACKGROUND OF THE INVENTION

1. Field of the Invention

This invention relates generally to water pressure regulating devices, and more particularly to systems for dampening water pressure fluctuations in pump systems used to supply fluids to wafer cleaning stations.

2. Description of the Related Art

As is well known, semiconductor devices are fabricated from semiconductor wafers, which are subjected to numerous processing operations. These operations include, for example, impurity implants, gate oxide generation, intermetal oxide depositions, metallization depositions, photolithography pattering, chemical mechanical polishing (CMP), etc. Although these processes are performed in ultra clean environments, the very nature of many of the process operations is to blame for the generation of surface particles. For instance, when CMP operations are performed, a film of particles and/or metal contaminants are commonly left behind.

Because surface particles can detrimentally impact the performance of an integrated circuit device, wafer cleaning operations have become a standard procedural requirement after certain process steps. Although cleaning operations are rather procedural, the equipment and chemicals implemented to perform the actual cleaning are highly specialized. This specialization is important because each wafer, being at different stages of fabrication, represents a significant investment in terms of raw materials, equipment fabrication time, and associated research and development.

To perform the cleaning operations in an automated manner, fabrication labs typically employ a cleaning system. A typical cleaning system may be, for example, a Synergy™ cleaning system from OnTrak™, of Fremont, Calif., which is a subsidiary of Lam Research Corporation, also of Fremont, Calif. A typical Synergy™ cleaning system employs two brush stations, where each brush station has a set of brushes for cleaning the top and bottom surfaces of a wafer. Each of the brushes are commonly configured to deliver chemicals and DI water Through-The-Brush, to enhance the cleaning ability of the system. The system typically also includes a spin-rinse station, where a wafer, after being cleaned in the brush stations is rinsed with DI water and dried before completing the cleaning cycle.

As can be appreciated, it is very important that facility lines, which supply the DI water to the cleaning system supply the water at substantially steady water pressure levels. Unfortunately, the facility lines in different fabrication labs vary substantially. In some cases, the pressure levels are too high and in others too low. In those cases where the pressure level is too low, laboratory technicians sometimes connect a water pump between the facility lines supplying the DI water and the cleaning system. Although water pumps are able to increase pressure levels, a downside to water pumps is that large pressure fluctuations are also introduced and passed to the cleaning system. In view of the fact that cleaning systems are designed to carefully apply selected amounts of DI water to produce very specific chemical solutions, (i.e., mixture) pressure fluctuations can cause erratic changes in the concentration of applied solutions.

In view of the foregoing, there is a need for pump systems and methods for implementing booster pump systems that minimize the degree of water pressure fluctuations communicated to wafer cleaning systems.

SUMMARY OF THE INVENTION

Broadly speaking, the present invention fills these needs by providing a booster pump that can supply water pressure sensitive cleaning systems with a controlled water pressure flow that has a substantial reduction in pulsating water pressure fluctuations. It should be appreciated that the present invention can be implemented in numerous ways, including as a process, an apparatus, a system, a device, or a method. Several inventive embodiments of the present invention are described below.

In one embodiment, a pressure booster for amplifying a water pressure that is supplied by a water facility is disclosed. The pressure booster includes a pump having a pump input that connects to the water facility and a pump output that is configured to produce a fluctuating amplified water pressure, which is greater than the water pressure that is supplied by the water facility. A pressure dampener having a dampener input for accepting the fluctuating amplified water pressure from the pump output is also included. The pressure dampener is configured to partially reduce pressure fluctuations in the fluctuating amplified water pressure, the pressure dampener also has a dampener output. The pressure booster further includes a pressure regulator having a regulator input for receiving the dampener output. The pressure regulator has a regulator output that is configured to supply a regulated water pressure having a substantially reduced pressure fluctuation. The regulated water pressure is then supplied to a wafer cleaning station, which is configured to perform precision controlled cleaning operations along with other cleaning chemicals.

In another embodiment, a pressure booster for amplifying a water pressure that is supplied by a water facility is disclosed. The pressure booster is configured to be connected between the water facility and one or more semiconductor substrate cleaning systems. The pressure booster includes a pump having a pump input that connects to the water facility and a pump output that is configured to produce a fluctuating amplified water pressure that is greater than the water pressure that is supplied by the water facility. Further included is a pressure dampener having a dampener input for accepting the fluctuating amplified water pressure from the pump output. The pressure dampener is configured to partially reduce pressure fluctuations in the fluctuating amplified water pressure. The pressure dampener also has a dampener output. A pressure regulator having a regulator input for receiving the dampener output is also included as part of the pressure booster. The pressure regulator has a regulator output that is configured to supply an amplified water pressure having a substantially reduced pressure fluctuation, and an adjustment control that is connected to the pressure regulator. The adjustment control is provided to enable precision tuning of the pressure fluctuations at the output of the pressure regulator, such that a substantially more stable water supply can be provided to the cleaning system(s) connected to the pressure booster.

In yet a further embodiment, a method for dampening a fluctuation in water pressure that is configured to be supplied to a wafer cleaning system is disclosed. The method includes: (a) providing a pump for amplifying a pressure level of water received from a facility connection; (b) connecting a pulse dampener to an output of the pump to partially reduce fluctuations in pressure produced by the pump; (c) connecting a pressure regulator to an output of the pressure regulator; (d) monitoring a pressure gauge at an output of the pressure regulator; and (e) adjusting the pressure regulator until an acceptable reduced pressure fluctuation is monitored at the pressure gauge.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE PREFERRED EMBODIMENTS

An invention is described for a booster pump that can supply water pressure sensitive cleaning systems with a controlled water pressure flow that has a substantial reduction in pulsating water pressure fluctuations. It will be obvious, however, to one skilled in the art, that the present invention may be practiced without some or all of these specific details. In other instances, well known process operations have not been described in detail in order not to unnecessarily obscure the present invention.

Figure 1:
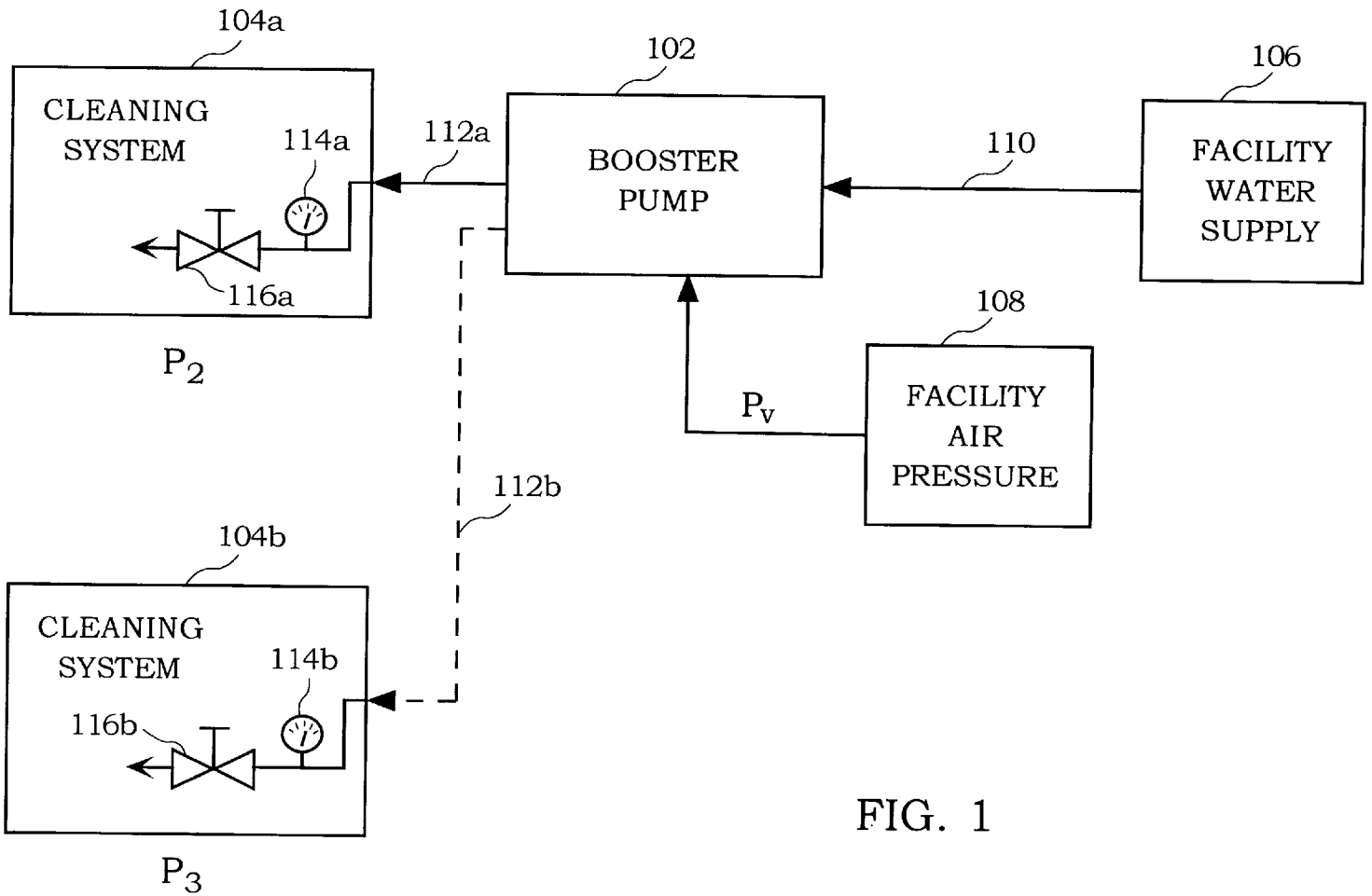
FIG. 1 illustrates a pair of cleaning systems that are connected to a water pressure amplifying system, in accordance with one embodiment of the present invention

FIG. 1 illustrates a pair of cleaning systems being connected to a water pressure amplifying system, in accordance with one embodiment of the present invention. The system includes a booster pump 102, which is connected between a facility water supply 106 and cleaning systems 104*a* and 104*b*. The booster pump 102 is also configured to receive a controlling air pressure ($P_v$) that is provided from a facility air pressure 108. Therefore, in situations where the facility water pressure 106 is below the pressure acceptable for running the cleaning systems 104*a* and 104*b*, a booster pump 102 is provided to increase the water pressure in a controlled manner.

As shown, the booster pump 102 is connected to the facility water supply 106 via a connection line 110. The connection line 110 is typically a tubing line that is configured to be connected to an appropriate connector at the facility water supply 106. The booster pump 102 is then configured to produce an amplified pressure 112*a* and 112*b* that is approximately the same or slightly greater than the pressure desired by the cleaning system 104*a* and 104*b*. In a typical Synergy™ cleaning system from OnTrack™, the desired pressure is about 50±5 PSI. Of course, the lower the pressure swing the better. In this embodiment, the pressure 112 is precision controlled internally to the booster pump 102 to reduce water pressure fluctuations that are common in conventional water pressure amplifying systems.

Each cleaning system 104, will preferably have a gauge 114*a* and 114*b*, respectively, for determining the water pressure characteristics provided from lines 112*a* and 112*b*. In order to provide the cleaning system with the appropriate controlled pressure for a particular cleaning process, each cleaning system 104*a* and 104*b* will also include a pressure regulating valve 116*a* and 116*b*, respectively. The pressure regulating valves 116*a* and 116*b* will thus enable the adjustment of the water pressure received from the booster pump 102 in order to obtain the optimum cleaning conditions for the system. However, if the water pressure is exhibiting erratic fluctuating swings in pressure, the regulating valves 116 alone are not capable of reducing the rate of fluctuations in the supplied water pressure. Thus, regulating valves 116 are primarily implemented to reduce or increase the pressure magnitude being passed into the cleaning systems 104.

Although the booster pump 102 is shown supplying water to two different cleaning systems 104, the booster pump 102 can also be configured to supply water to a single cleaning system, or more than two cleaning systems, depending upon the booster pump specifications.

Figure 2A:
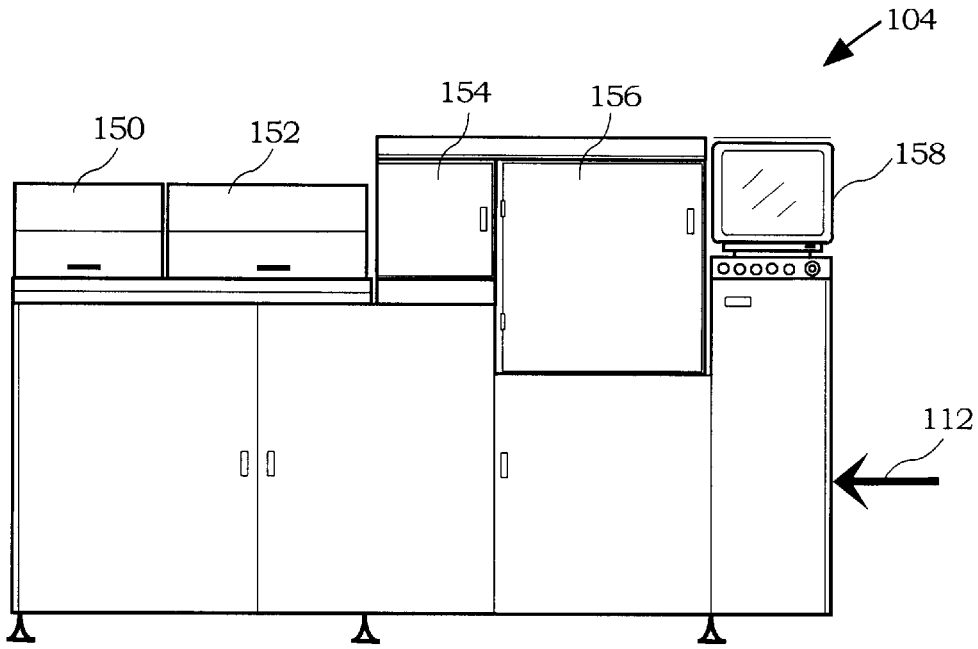
FIGS. 2A and 2B show a side view and a top view, respectively, of a wafer cleaning system.
Figure 2B:
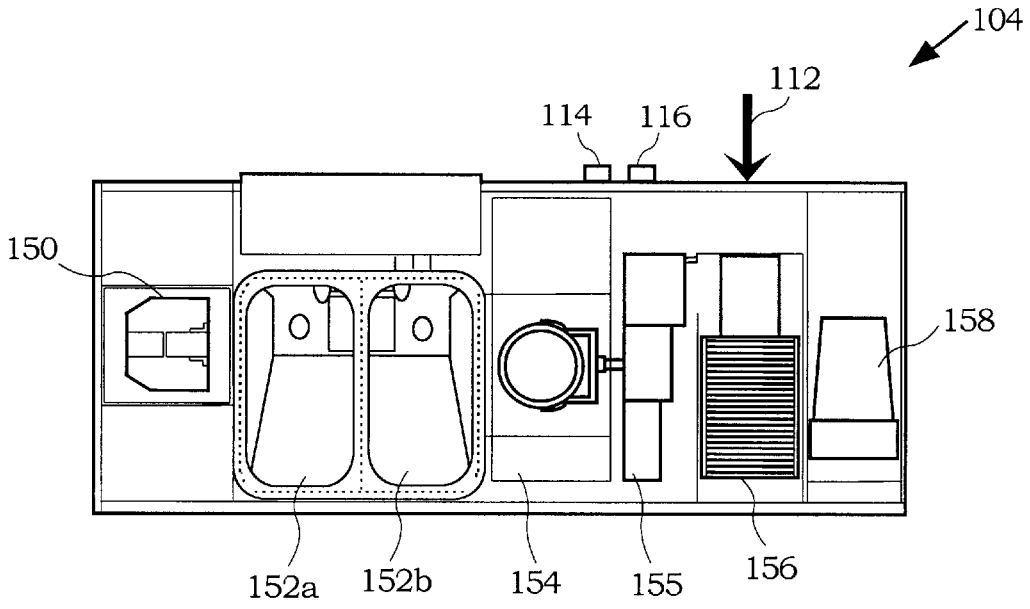

FIGS. 2A and 2B show a side view and a top view, respectively, of a cleaning system 104. The cleaning system 104 typically includes a input station 150 where a plurality of wafers may be inserted for cleaning through the system. Once the wafers are inserted into the input station 150, a wafer may be taken from the input station 150 and moved into a first brush station 152*a*, where the wafer is scrubbed with selected chemicals and water (e.g., DI water), before being moved to a second brush station 152*b* of a double contained dual brush box 152.

After a wafer has been scrubbed in the double contained dual brush box 150, the wafer is moved into a spin station 154 where de-ionized water is sprayed onto the surface of the wafer and spun to dry. After the wafer has been rinsed in spin station 154, an unload handler 155 takes the wafer and moves it into an output station 156. The cleaning system 104 is configured to be programmed and controlled from system electronics 158. The cleaning system 104 also shows the input water line 112, which is received from the booster pump 102 as shown in FIG. 1. The cleaning system 104 also shows the gauge 114 and the adjustment valve 116 at the backside of the cleaning station 104.

Figure 3:
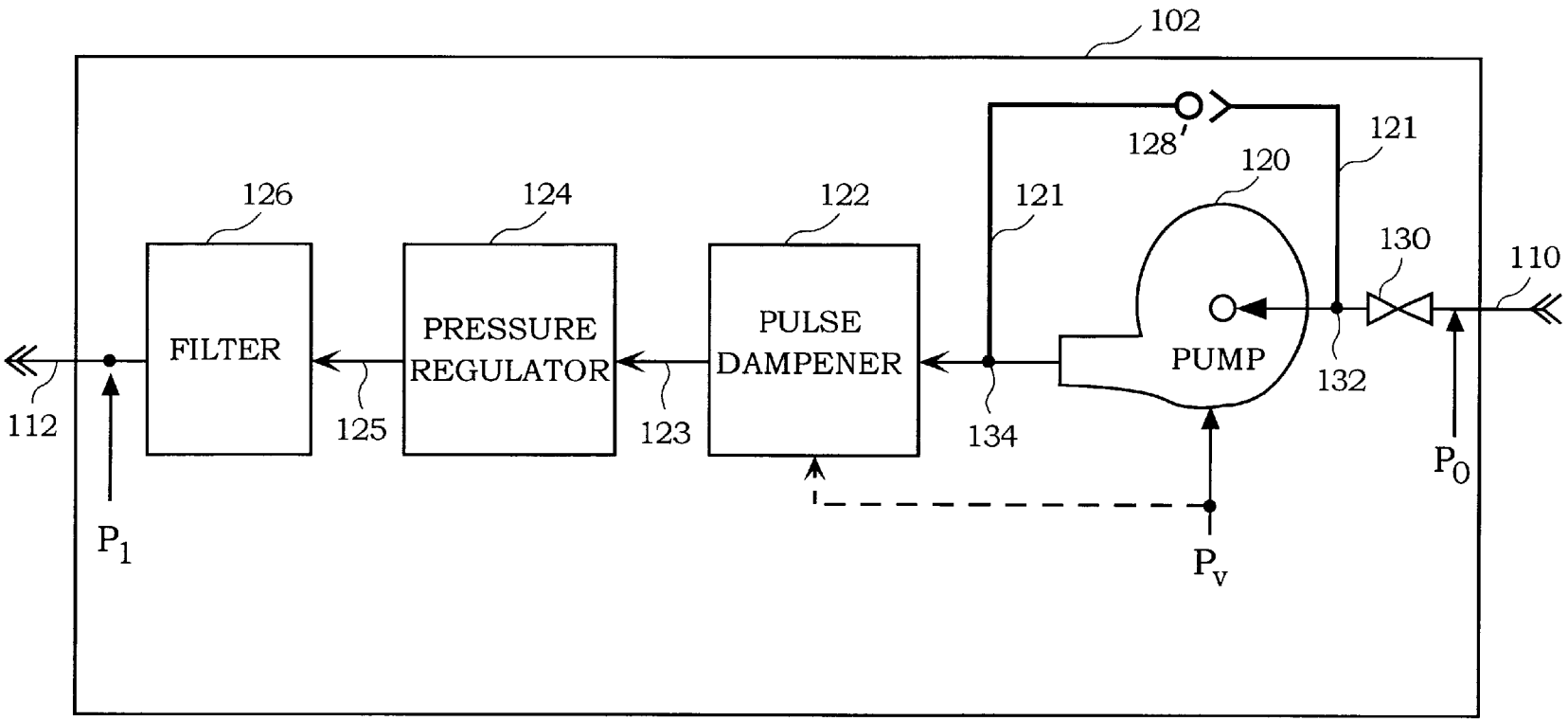
FIG. 3 shows a more detailed block diagram of the booster pump, in accordance with one embodiment of the present invention.

FIG. 3 shows a more detailed block diagram of the booster pump 102, in accordance with one embodiment of the present invention. The booster pump 102 is shown receiving the connection line 110 that leads to an input shutoff 130. The input shutoff 130 then leads to a tee connection 132 that flows to a pump 120 and through a bypass line 121 that leads to a check valve 128. In an exemplary embodiment, the pump 120 is a Yamada ¾" NDP-20 Series Pump, wherein about 0.10 gallon is pumped per pump cycle. This exemplary NDP-20 Series Pump can be obtained from Yamada America, Inc., of Elgin, Ill. Of course, the pump may be obtained from other manufacturers and the pumping power can vary depending upon the needs of the cleaning system arrangement. The pump 120 is also shown receiving a controlling air pressure $P_v$ from the facility air pressure 108 of FIG. 1. In a preferred embodiment, the controlling air pressure is set to about 85 PSI, and it may range between about 20 and 100 PSI.

The pump 120 is then configured to output an amplified water pressure to a tee 134 that connects to the bypass line 121 and a pulse dampener 122. The controlling air pressure $P_v$ is also connected to the pulse dampener 122. An exemplary pulse dampener ay be an AD-Series (e.g., an AD-25PT) pulsation dampener, which is also manufactured by Yamada America, Inc. The pulse dampener 122 is configured to partially reduce pressure fluctuations produced by the pump 120. Once the water is passed through the pulse dampener 122, the water is passed to a line 123 that is communicated to a pressure regulator 124. The pressure regulator 124 is configured to be adjusted such that a desired pressure ($P_1$) is achieved at the output of the booster pump 102. The pressure regulator 124 then flows the water through a line 125 to enter a filter 126 that filters the water before it is provided to line 112.

Figure 4:
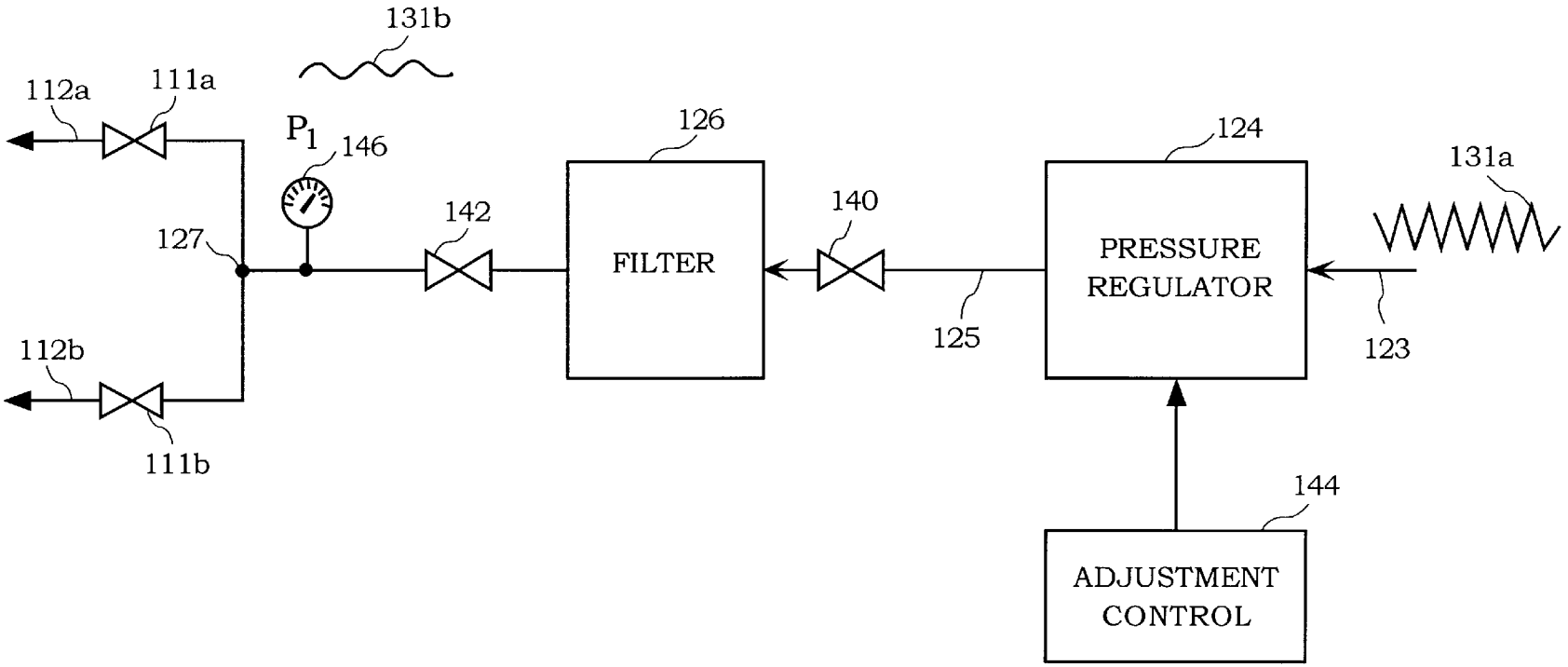
FIG. 4 shows a more detailed diagram of a pressure regulator implemented by the booster pump of FIG. 1, in accordance with one embodiment of the present invention.

FIG. 4 shows a more detailed diagram of the pressure regulator 124 in accordance with one embodiment of the present invention. The pressure regulator 124 is shown receiving water having a fluctuating water pressure through line 123. The pressure regulator is also provided with an adjustment control 144. The adjustment control 144 enables precision control of the pressure level and tuning control over water pressure fluctuations between the water flowing through line 123 and the water flowing out of the pressure regulator 124 in line 125. The filter 126 is shown connected between filter isolation valves 140 and 142. The filter isolation valves 140 and 142 are used to shut off the conduction of water through the filter 126 when replacement of the filter is desired.

Also shown is a pressure gauge 146 which is connected to the output of the filter 126 in order to measure the pressure ($P_1$). The gauge 146 is then connected to a tee that splits the line into the lines 112*a* and 112*b*. Output shutoffs 111*a* and 111*b* are also provided to enable the sealing off of one of the lines 112*a* or 112*b* depending upon the number of cleaning systems connected to the booster pump 102. The adjustment control 144 can be a manual control, a pressure control, or an electronic control which enables adjustment of the pressure regulator 124. In one exemplary embodiment, the pressure regulator can be a manually controlled UPR Pressure Regular, which can be obtained from Furon Co. of Los Alamitos, Calif. The adjustment control 144 is therefore tuned while at the same time the pressure gauge 146 is monitored. The simultaneous monitoring therefore enables the user to tune the pressure regulator 124 to the most optimum setting, which will produce the best reduction in water pressure fluctuation. The pressure output from the pulse dampener 122 provided at line 123 is pictorially shown to have sporadic fluctuations in pressure 13 la, which may swing up to 20 PSI or greater.

By monitoring the pressure gauge 146, an adjustment is made through the adjustment control 144 to the pressure regulator 124 until the pressure gauge 146 shows a waveform 131*b* that exhibits lower magnitude swings, e.g., below about 5 PSI. The fluctuations will also preferably exhibit a wider period between fluctuating transitions.

In Tables A and B, which follow below, experimental data is provided to show how precision control of the pressure regular 124, which is connected after the pulse dampener 122, will provide significant reductions water pressure fluctuations. For ease of reference, when a system is in process mode (i.e., wafers are being cleaned), the system will be designated as "P." When the system is in flush/purge mode, the system will be designated as "U." When the system is in an idle state, the system will be designated as "I."

In Tables A and B, the facility pressure level $P_0$ will be tested at about 45 PSI (i.e., the facility water supply pressure), and the control pressure Pv will be set at 85 PSI. The desired and most optimum pressure that is to be delivered to the systems A and B, in this example, is 50 PSI. However, it is more important that the fluctuation and pulsation in water pressure be at a minimum, and if the pressure P2 (at system A) and P3 (at system B) are too high, another adjustment in pressure can be performed at the pressure regulating valves 116*a* and 116*b* (as shown in FIG. 1). That is, if the pressure is higher than 50 PSI, albeit, with substantially reduced fluctuation and pulsation, the pressure can simply be reduced by the pressure regulating valves 116*a* and 116*b*.

In Table A, the connection line 110, which connects the booster pump 102 to the water facility 106, includes a Y adapter using 1" ID and ¾" tubing. The Y adapter is used when two facility water lines are provided to the booster pump 102, and the Y adapter converts the two lines into a single line. The length of the two ¾" lines between the Y adapter and the water facility 106 is about 10 feet. A one foot ¾" line is then connected between the Y adapter and the booster pump 102. The lines 112 connected between the booster pump 102 and the systems A and B are set as 45 foot long ¾" tubing and 9 foot long ¾" tubing, respectively. Implementing these connection conditions, the results of Table A were observed when the systems were placed in the various operational conditions. It should be noticed that the measured pressure fluctuations exhibited less than a 5 PSI swing in each of the process combinations.

TABLE A

TEST SETUP A

| System A/ System B | $P_0$ (PSI) | $P_1$ (PSI) | $P_2$ (PSI) | $P_3$ (PSI) | $P_v$ (PSI) |
|---|---|---|---|---|---|
| P/P | ~45 | 61–62 | 50–53 | 49–51 | 85 |
| P/U | ~45 | 56–59 | 49–53 | 44–46 | 85 |
| P/I | ~45 | 61–63 | 49–53 | 50–54 | 85 |
| I/I | ~45 | 61–67 | 49–53 | 50–54 | 85 |

In Table B, the connection line 110, which connects the booster pump 102 to the water facility 106, includes a 10 foot long 1" tube and a 1 foot long ¾" piece of tubing that couples between the 1" tubing, and the booster pump 102. The line 112 is connected between the booster pump 102 and the system A with a 45 foot long ¾" tubing. No connection was made to the system B. Implementing these connection conditions, the results of Table B were observed when the system A was placed in various operational conditions. As shown, during process mode "P" and during idle mode "I", the pressure swings were less than about 2 PSI. During flushing, which is less important in terms of precise wafer cleaning, the measured swing was about 6 PSI.

TABLE B

TEST SETUP B

| System A/ System B | $P_0$ (PSI) | $P_1$ (PSI) | $P_2$ (PSI) | $P_3$ (PSI) | $P_v$ (PSI) |
|---|---|---|---|---|---|
| P/N/A | ~45 | 58–61 | 50–52 | N/A | 85 |
| U/N/A | ~45 | 55–65 | 43–49 | N/A | 85 |
| I/N/A | ~45 | 58–66 | 50–52 | N/A | 85 |

Figure 5:
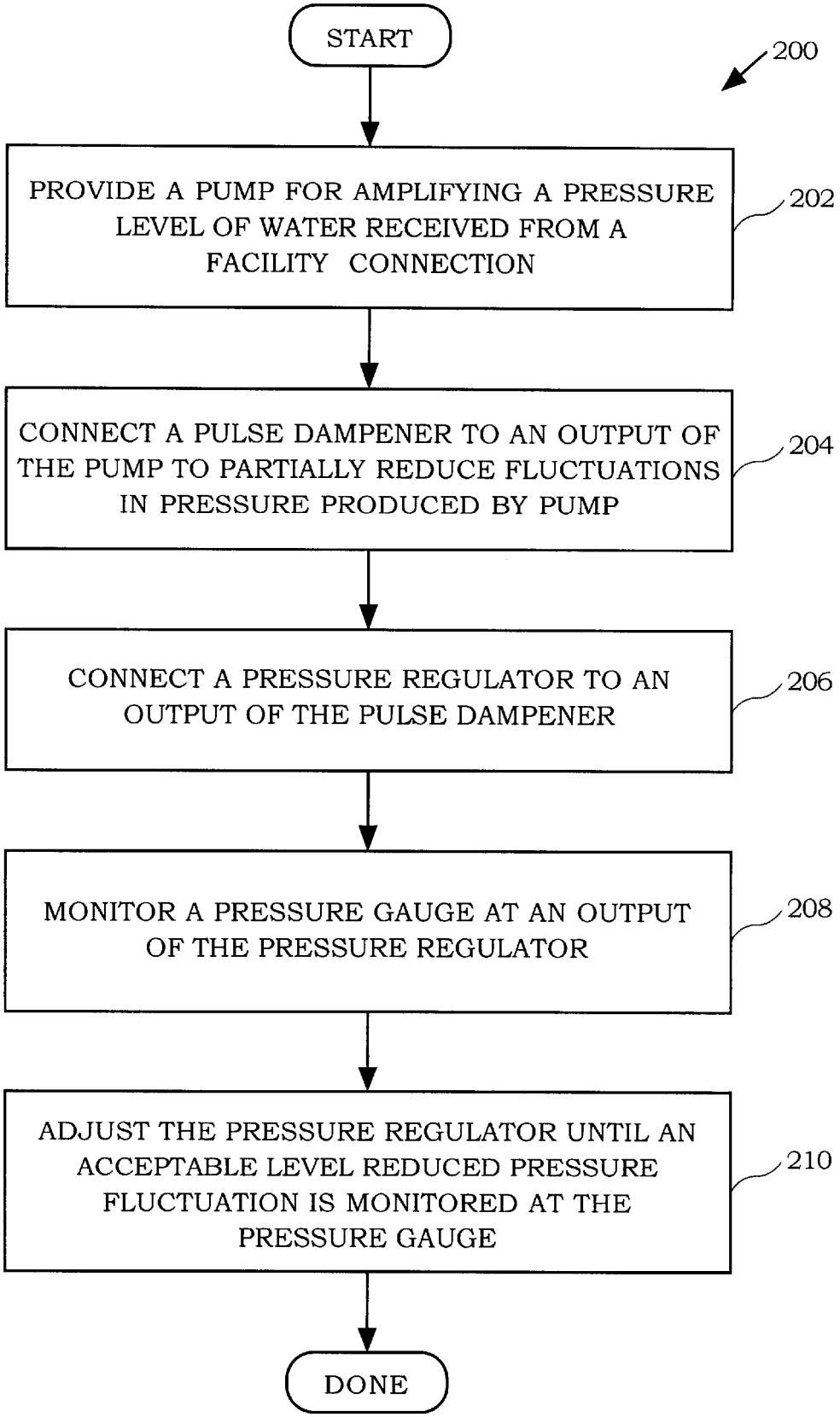
FIG. 5 is a flowchart diagram illustrating the method operations performed in reducing pressure fluctuation and pulsation in water lines connected to cleaning systems via a booster pump, in accordance with one embodiment of the present invention.

FIG. 5 is a flowchart diagram 200 illustrating the method operations performed in reducing pressure fluctuation and pulsation in water lines connected to cleaning systems via a booster pump, in accordance with one embodiment of the present invention. The method begins at an operation 202 where a pump for amplifying a pressure level of water received from a facility connection is provided. The facility connection may be provided from a wall outlet connection or a floor outlet connection which are part of a room where the cleaning system(s) is to be installed. Upon providing the pump, the method will advance to an operation 204 where a pulse dampener is connected to an output of the pump to partially reduce fluctuations in pressure produced by the pump. Once the pulse dampener has been connected, a pressure regulator is connected to an output of the pulse dampener.

Now, a pressure gauge (e.g., gauge 146 for measuring $P_1$) at an output of the pressure regulator is monitored to ascertain the fluctuations in pressure after passing through the pressure regulator. The method then moves to an operation 210 where adjustments to the pressure regulator are made until an acceptable reduced pressure fluctuation is monitored at the pressure gauge. As mentioned above, the adjustment may be made by way of a manual adjustment to the pressure regulator, an air controlled adjustment mechanism, or an electronic controlled adjustment unit.

Once the appropriate adjustment to the pressure regulator has been performed in order to achieve the reduced pressure fluctuation, the booster pump including the pulse dampener, and the pressure regulator, are connected to an appropriate cleaning system for use in accordance with a particular cleaning process. At that point, the method will end.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A pressure booster for amplifying a water pressure that is supplied by a water facility, comprising:

a pump having a pump input that connects to the water facility and a pump output that is configured to produce a fluctuating amplified water pressure that is greater than the water pressure that is supplied by the water facility;

a pressure dampener having a dampener input for accepting the fluctuating amplified water pressure from the pump output, the pressure dampener being configured to partially reduce pressure fluctuations in the fluctuating amplified water pressure, the pressure dampener further having a dampener output;

a pressure regulator having a regulator input for receiving the dampener output, the pressure regulator further having a regulator output that is configured to supply an amplified water pressure having a substantially reduced pressure fluctuation;

an adjustment control connected to the pressure regulator; and a pressure gauge connected to the regulator output, the pressure gauge being configured to display a pressure reading and a fluctuation reading.

2. A pressure booster for amplifying a water pressure that is supplied by a water facility as recited in claim 1, further comprising:

a filter coupled between the regulator output and the pressure gauge.

3. A pressure booster for amplifying a water pressure that is supplied by a water facility as recited in claim 1, wherein the adjustment control that is connected to the pressure regulator is set to a position that causes the amplified water pressure to have the substantially reduced pressure fluctuation.

4. A pressure booster for amplifying a water pressure that is supplied by a water facility, the pressure booster is configured to be connected between the water facility and one or more semiconductor substrate cleaning systems, the pressure booster comprising:

a pump having a pump input that connects to the water facility and a pump output that is configured to produce a fluctuating amplified water pressure that is greater than the water pressure that is supplied by the water facility;

a pressure dampener having a dampener input for accepting the fluctuating amplified water pressure from the pump output, the pressure dampener being configured to partially reduce pressure fluctuations in the fluctuating amplified water pressure, the pressure dampener further having a dampener output;

a pressure regulator having a regulator input for receiving the dampener output, the pressure regulator further having a regulator output that is configured to supply an amplified water pressure having a substantially reduced pressure fluctuation;

an adjustment control connected to the pressure regulator; and a pressure gauge connected to the regulator output, the pressure gauge being configured to display a pressure reading and a fluctuation reading.

5. A pressure booster for amplifying a water pressure that is supplied by a water facility as recited in claim 4, further comprising:

a filter coupled between the regulator output and the pressure gauge.

6. A pressure booster for amplifying a water pressure that is supplied by a water facility as recited in claim 4, wherein the adjustment control that is connected to the pressure regulator is set to a position that causes the amplified water pressure to have the substantially reduced pressure fluctuation.

* * * * *